United States Patent [19]

Böhm

[11] Patent Number: 4,515,645

[45] Date of Patent: May 7, 1985

[54] PROCEDURE FOR BRIGHT ANNEALING OF METALLIC WORK PIECES USING NITROGEN AS PROTECTIVE GAS

[75] Inventor: Gottfried Böhm, Mühlheim-Ruhr, Fed. Rep. of Germany

[73] Assignee: Messer Griesheim GmbH, Frankfurt am Main, Fed. Rep. of Germany

[21] Appl. No.: 530,748

[22] Filed: Sep. 9, 1983

[30] Foreign Application Priority Data

Sep. 21, 1982 [DE] Fed. Rep. of Germany ..... 3234863

[51] Int. Cl.[3] ..... C21D 1/62

[52] U.S. Cl. ..... 148/16; 266/121

[58] Field of Search ..... 266/121; 148/16

[56] References Cited

U.S. PATENT DOCUMENTS 3,036,825 5/1962 Eisenmenger ..... 266/121

3,189,490 6/1965 Scott ..... 266/121

3,407,099 10/1968 Schell ..... 266/121

3,507,712 4/1970 Scott ..... 266/121

*Primary Examiner*—Veronica O'Keefe

*Attorney, Agent, or Firm*—Connolly and Hutz

[57] ABSTRACT

Metallic work pieces are annealed under protective gas in bright annealing furnaces with subsequent cooling line. Exogas or nitrogen is used as protective gas. In the latter case, liquid nitrogen is evaporated and introduced at several locations in the bright annealing furnace and the cooling line.

For the purpose of decreasing the installation costs, increasing the performance and improving the quality, the liquid nitrogen is sprayed without prior evaporation onto the material to be annealed, namely in the end zone of the cooling line.

2 Claims, 3 Drawing Figures

PROCEDURE FOR BRIGHT ANNEALING OF METALLIC WORK PIECES USING NITROGEN AS PROTECTIVE GAS

BACKGROUND OF INVENTION

The invention concerns a procedure and a device for bright annealing of metallic work pieces in a bright annealing furnace with a connected cooling line using nitrogen as the protective gas.

In bright annealing furnaces for work pieces of steel, iron or non-ferrous metals, the work pieces are annealed under protective gas. Either exogas or nitrogen is used as protective gas. In the case of using nitrogen, liquid nitrogen is evaporated in an air evaporator and introduced at several locations in the annealing furnace and the cooling line, similar to the procedure using the exogas. Hereby the valuable cold of the liquid nitrogen is lost without being utilized.

SUMMARY OF INVENTION

An object of the invention is to improve the bright annealing process with nitrogen as the protective gas in such a manner that the installation costs are decreased and it is possible to improve the performance and at least for some metals to achieve an improvement of the quality as well while at the same time the cold content of the liquid nitrogen is utilized.

In a procedure according to the invention for bright annealing of metallic work pieces in a bright annealing furnace with a subsequent cooling line and using nitrogen as the protective gas, the objects are achieved by spraying the nitrogen in its liquid form onto the material to be annealed, namely in the end area of the cooling line.

The direction of the spray preferably deviates 15° to 20° from the vertical and is opposed to the movement direction of the material to be annealed. This results in an optimum heat exchange between the material to be annealed and the liquid nitrogen as well as in excellent flow conditions for the evaporated nitrogen throughout the cooling line and the bright annealing furnace.

The nitrogen consumption is the same as in the procedure to date in which the liquid nitrogen is evaporated in an air evaporator. However, since according to the invention the liquid nitrogen is evaporated in the cooling line, it is unnecessary to provide an air evaporator. As compared to the procedure using exogas or gaseous nitrogen as protective gas, a performance improvement is possible as well as a quality improvement at least for some metals this due to a more intense cooling of the work pieces. Contrary to the result of the procedure according to the state of the art and due to the intense cooling of the work pieces in the procedure according to the invention, the work pieces will no longer tarnish after leaving the cooling line.

This is demonstrated in the comparative experiments which are described in the following.

In each case 2,000 kg/h stretched copper pipe or 1,500 kg/h wound copper coil was annealed. When exogas was used, 130 $m^3/h$ was needed. The temperature of the copper pipes and copper coils upon leaving the cooling line was 140° C. The copper coils and the copper pipes tarnished.

In the application according to the invention of liquid nitrogen, 152 kg/h liquid nitrogen was required, corresponding to 130 $m^3/h$ gaseous nitrogen. The exit temperature of the copper pipes or copper coils was only 95° C., and as a result, the work pieces no longer tarnished.

By means of corresponding dosage of the liquid nitrogen, both the exit temperature and the throughput quantity can be varied in a simple manner. This is a particular advantage of the procedure according to the invention. If, on the other hand, one should desire to increase the throughput performance according to the state of the art, the cooling line would have to be lengthened.

THE DRAWINGS

DETAILED DESCRIPTION

Figure 1:
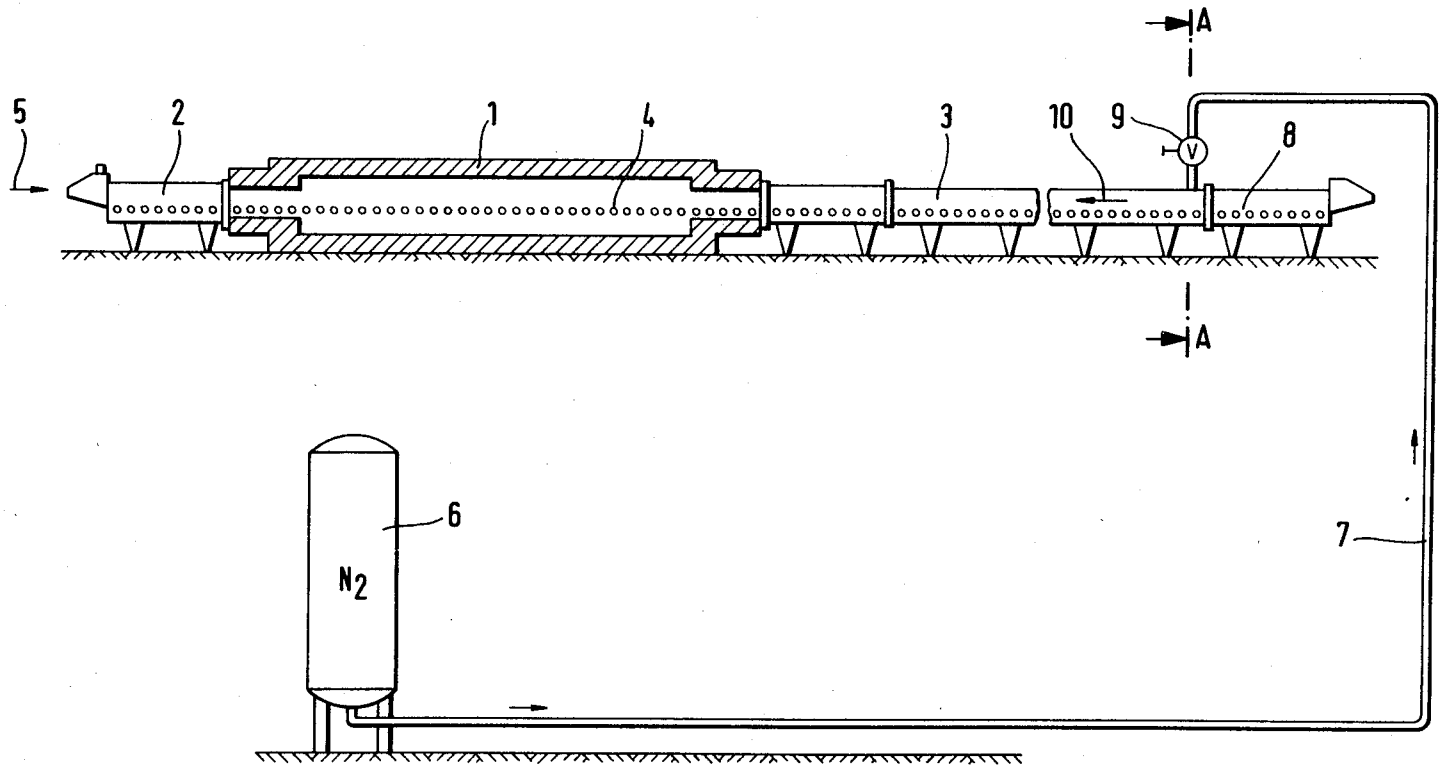
FIG. 1 is a section through a bright annealing furnace with a subsequent cooling line and supply of liquid nitrogen in the end zone of the cooling line.

FIG. 1 shows a section of a bright annealing furnace 1 at the intake side of which there is an entry line 2 and on the exit side of which there is a cooling line 3. The material to be annealed is transported through the bright annealing furnace 1 on transport rollers 4; the direction of movement of the material to be annealed is indicated by means of the arrow 5. Nitrogen is used as protective gas and is supplied in liquid form from the insulated tank 6 and through the insulated line 7 to the bright annealing furnace 1. According to the invention, the liquid nitrogen is sprayed directly into the end zone 8 of the cooling line 3 without prior evaporation. The dosage is carried out by means of a control valve 9; in addition, common transport and monitoring devices are provided although not shown in the drawing, namely such as phase separators, thermometers and manometers. The sprayed-in liquid nitrogen evaporates through heat exchange with the still hot material to be annealed flows in gaseous form through the cooling line 3 and the bright annealing furnace 1 and leaves the installation through the entry line 2. The flow direction of the gaseous nitrogen is indicated with an arrow 10.

Figure 2:
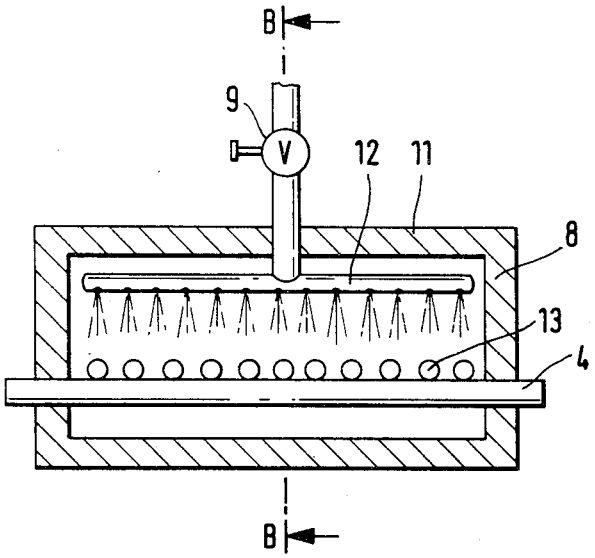
FIG. 2 is a section along the line A—A in FIG. 1.
Figure 3:
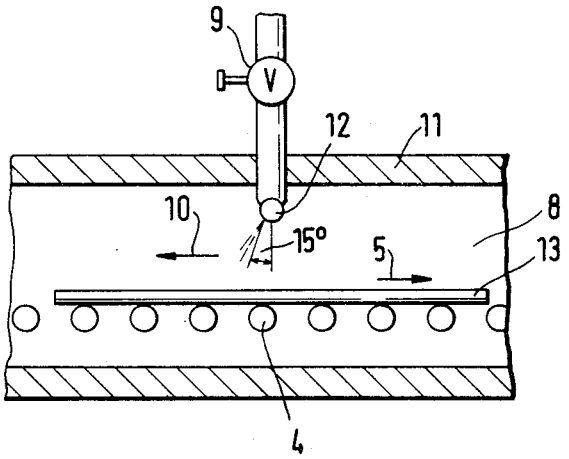
FIG. 3 is a section along the line B—B in FIG. 2.

A preferred device for spraying the liquid nitrogen into the cooling line 3 is illustrated in FIGS. 2 and 3. The liquid nitrogen is fed to the nozzle assembly 12 which is arranged in the cover 11 of the end zone 8 of the cooling line 3. In the nozzle assembly 12, there are borings which are arranged so that the liquid nitrogen exits at an angle of 15° deviation from the vertical, against the movement direction of the material 13 to be annealed as shown in FIG. 3. The sprayed-out liquid nitrogen thus impacts almost vertically onto the material 13 to be annealed which causes intensive heat exchange and rapid evaporation of the nitrogen. Simultaneously the nitrogen is set in motion towards the annealing furnace 1 and the entry line 2.

The invention is not limited to this device. For instance the exit angle of 15° can also be achieved thereby that the entry pipe for the liquid nitrogen is correspondingly angled in the cooling line 3. Several nozzle assemblies may also be sequentially arranged.

What is claimed is:

1. In a process for bright annealing of metallic work pieces in a bright annealing furnace with subsequent cooling line and using nitrogen as protective gas, the improvement being spraying the nitrogen in liquid form onto the material to be annealed in the exit end zone of the cooling line.

2. Process according to claim 1, characterized thereby that the nitrogen is sprayed in at an angle of 15° to 20° from the vertical against the movement direction of the material to be annealed.

* * * * *